US005918995A

United States Patent [19]

Puurunen

[11] Patent Number: 5,918,995

[45] Date of Patent: Jul. 6, 1999

[54] TOOTHBRUSH WITH PUMP

[76] Inventor: Juha-Pekka Puurunen, Selantie 4 B 2, FIN-25500 Perniö , Finland

[21] Appl. No.: 08/945,824

[22] PCT Filed: Dec. 10, 1996

[86] PCT No.: PCT/FI96/00653

§ 371 Date: Nov. 5, 1997

§ 102(e) Date: Nov. 5, 1997

[87] PCT Pub. No.: WO97/22281

PCT Pub. Date: Jun. 26, 1997

[30] Foreign Application Priority Data

Dec. 15, 1995 [FI] Finland ..... 956061

[51] Int. Cl.[6] ..... A46B 11/02

[52] U.S. Cl. ..... 401/146; 401/156; 401/184; 401/186

[58] Field of Search ..... 401/146, 149, 401/150, 184, 186, 156

[56] References Cited

U.S. PATENT DOCUMENTS

| | | | |
|---|---|---|---|
| 1,392,369 | 10/1921 | Stoewsand | 401/150 |
| 3,118,166 | 1/1964 | Bell | 401/150 X |
| 3,903,888 | 9/1975 | Buelow et al. | 401/150 X |
| 4,692,047 | 9/1987 | Endo . | |
| 4,893,957 | 1/1990 | Byriel . | |
| 4,963,046 | 10/1990 | Eguchi . | |
| 4,971,470 | 11/1990 | Moeck et al. | 401/150 |
| 5,393,153 | 2/1995 | Bouthillier et al. . | |

FOREIGN PATENT DOCUMENTS

| | | | |
|---|---|---|---|
| 523340 | 4/1956 | Canada | 401/150 |

*Primary Examiner*—Steven A. Bratlie
*Attorney, Agent, or Firm*—Burns, Doane, Swecker & Mathis, L.L.P.

[57] ABSTRACT

A pump toothbrush includes a brush portion, a grip portion and an intermediate arm portion. The grip portion includes a container portion for dental cleansing medium and is connected to the brush portion by way of a pump device to feed the dental cleansing medium into the brush portion through the intermediate arm portion. The pump device includes a frame portion that is arranged between the container portion and the arm portion. The frame portion is provided with a recess located perpendicularly with respect to the longitudinal axis of the pump toothbrush. An adjusting body forming an inner portion of the pump device is fitted into the recess in the frame portion. The adjusting body possesses an axial outwards open intermediate space that functions as a chamber in the pump device. The intermediate space in the adjusting body is closed by a flexible pressure membrane. In addition, inlet and outlet valves are arranged in the adjusting body to enable connection between and transfer of dental cleansing medium from the container portion to the brush portion through the inlet and outlet valves when pressure is applied to the flexible pressure membrane.

20 Claims, 2 Drawing Sheets

TOOTHBRUSH WITH PUMP

Figure 1:
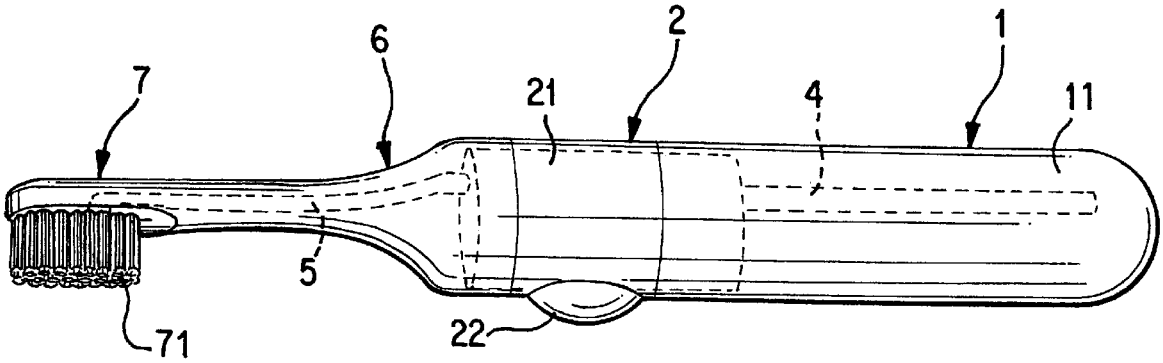

The present invention relates to a pump toothbrush comprising a brush portion, a grip portion and an intermediate arm portion, whereby the grip portion comprises a container portion for a cleansing medium, said container portion is connected with the brush portion by means of a pump device in order to feed the cleansing medium into the brush portion through the arm portion.

Toothbrushes of this type are disclosed, for example, in U.S.-applications U.S. Pat. No. 4,717,278, U.S. Pat. No. 5,096,321, U.S. Pat. No. 4,963,046 and U.S. Pat. No. 5,393,153.

The first mentioned publication discloses two different types of solutions. According to the first solution the cleansing medium is provided in a pressurized aerosol container which has to be pierced in order to bring the cleansing medium to the brush portion. According to the second solution a conventional hose pump is used in order to feed the cleansing medium into the feeding arm by means of which the cleansing medium is sprayed onto the brush portion from the outside. In toothbrushes of this type the cleansing medium is fed in quite an uncontrolled way which is unpleasant both for the user and the environment. Moreover it is difficult to use and clean the toothbrush. Additionally, the complex structure is easily damaged. The second publication discloses a pump device with a complex structure which not only makes the manufacturing costs high but also makes it difficult to use. The publication U.S. Pat. No. 4,963,046 discloses several solutions using pressure membrane pumps arranged to a disengageable container portion or an arm portion. In the disclosed solutions the flow conduits are complicated and are easily clogged or the pumping effect is insufficient to open clogged-up conduits. The solution according to the publication U.S. Pat. No. 5,393,153 discloses a pressure button and a piston pump which has a line of action that can cause an uncontrolled flow of cleansing medium. In addition, the disclosed structures are complex and expensive to manufacture.

Several solutions for connecting a toothbrush and a container containing a cleansing medium have been proposed. The disadvantage of the previously known solutions is usually complicated and costly structures. In most cases they have been lacking user-friendliness and reliability. The winding conduits full of a cleansing medium in a toothbrush which has not been used for a long time may have been so badly clogged that it is no longer possible to use the toothbrush according to its original purpose.

The object of the present invention is to remedy the aforementioned defects and to obtain a pump toothbrush which is simple to manufacture, reliable and easy and tidy to use. This object is achieved by means of the pump toothbrush according to the present invention.

The pump toothbrush according to the invention comprises a frame portion arranged between a container portion and an arm portion. The container portion, the frame portion and the arm portion form a congruent casing. The pump toothbrush according to the invention comprises only the three above mentioned portions which are easy to clean, service and replace. An adapting body is fitted into an advantageously cylindrical recess in the frame portion of the pump, said body containing the chamber and valves of the pressure membrane pump. The pressure membrane also acts as a sealing between the adapting body and the frame portion. The pipeline for the dental cleansing medium running from the container portion to the brush portion is essentially straight. An aerator valve is attached to the container portion for emptying it. The portions of the adapting body, the intermediate space and the valves are open previous to being fitted into the recess in the frame portion. The function of the pressure membrane can be intensified by mounting a spring into the expansion of the intermediate space.

The basic idea of the invention is that the structure and design of the pump toothbrush can be made almost as simple as those of an ordinary toothbrush, whereby it is possible in a natural manner to make use of the additional features it has compared to an ordinary toothbrush especially in connection with brushing. This is advantageously carried out so that the design and structure of the pump device is integrated between the grip portion containing the cleansing medium and the arm portion leading to the brush portion. In addition the activating means of the pump device, advantageously a flexible pressure membrane, is arranged in the region of the grip portion and arm portion, preferably in the surface of their casing. Thereby it is possible by a natural and light squeeze to feed the cleansing medium whenever need be to the bristles of the brush portion simultaneously with the brushing movement.

The simple pump device according to the invention can be easily adapted to toothbrushes of different sizes, whereby the size can be chosen according to different times of use which may, for example, be domestic use by adults or children, journeys or one-time use. The mutual fittings of the portions of the pump toothbrush according to the invention further this use.

Figure 2:
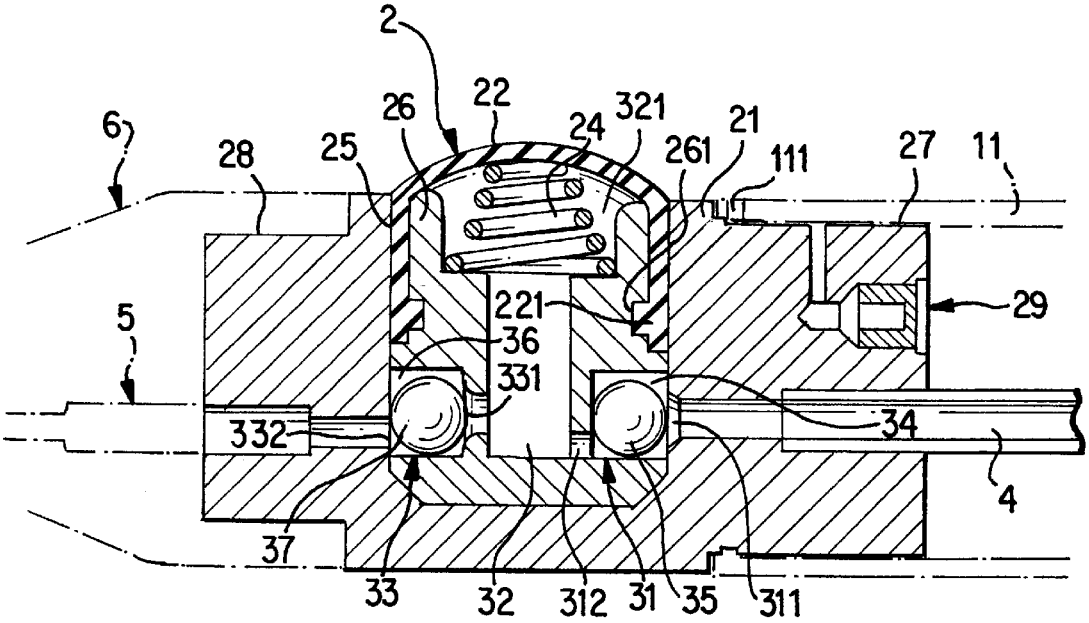
Figure 3:
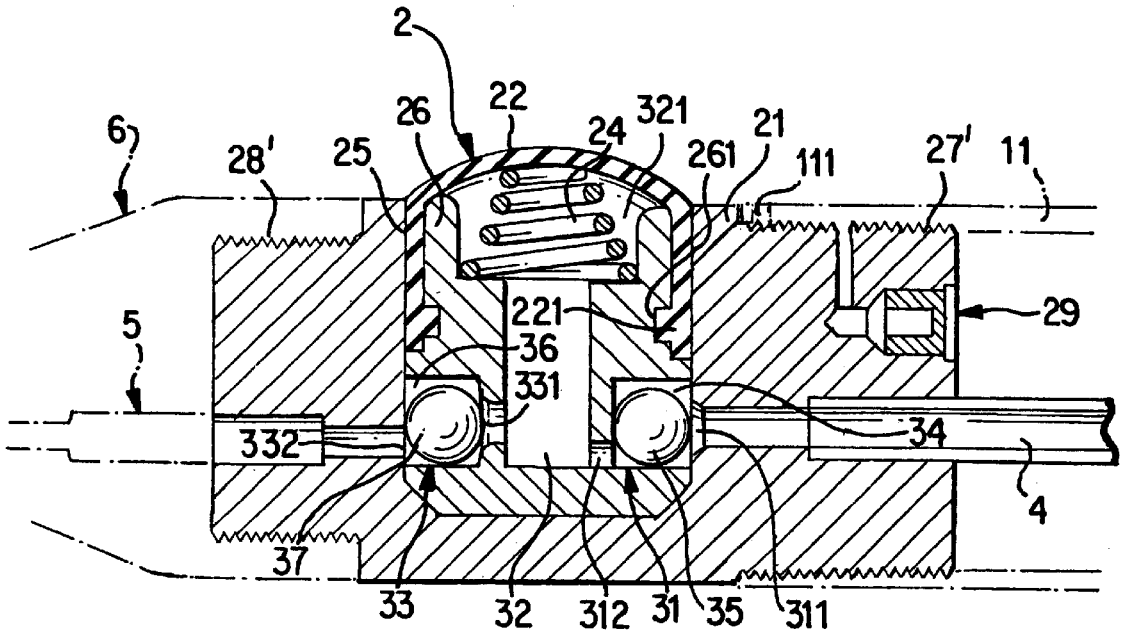

In the following a preferred embodiment of the invention will be described in detail with reference to the enclosed schematic drawing, in which FIG. 1 shows a perspective view of the pump toothbrush according to the invention, FIG. 2 shows a section view illustrating the pump device; and FIG. 3 is a section view similar to FIG. 2 illustrating an alternative mechanism for connecting the frame portion with the arm portion and the container portion.

The pump toothbrush shown in FIGS. 1 and 2 comprises a grip portion 1 with a container portion 11 for a cleansing medium. The grip portion 1, or the container portion 11, is attached to the other side of a frame portion 21 of a pump device 2, whereby an arm portion 6 is attached to the opposite side with respect to the grip portion of the frame portion of the pump device, said arm portion extending into a brush portion 7 provided with bristles 71. The grip portion 1, i.e. the container portion 11, the frame portion 21 of the pump device 2 and the arm portion 6 comprise essentially congruent casing portions.

A first duct, for example a hose or pipe 4 extending to the container portion 11 is connected to the pump device 2, said duct being connected by means of a first valve 31, an inlet valve, to an intermediate space 32 formed in an adapting body 26 of the pump device 2. Additionally a second duct, which can be, for example, a hose, conduit or pipe 5, is connected to the pump device 2 extending via the arm portion 6 to the brush portion 7, said duct being connected by a second valve 33, an outlet valve, to the intermediate space 32 from the opposite side with respect to the first pipe 4 of the frame portion 21. The pipeline formed by the pump device 2 and the pipes 4 and 5 does not contain any bends which facilitates transfer of the cleansing medium from the container portion 11 to the bristles 71.

The activating member of the pump device 2, i.e. the pressure membrane pump, typically consists of a pressure membrane 22 and a spring 24 by means of which a pressure or suction effect is obtained in the intermediate space 32 in order to transfer the cleansing medium from the container portion 1 to the brush portion 7. It is possible to fit a valve (not shown) in the bristles 71 of the brush portion 7 at the point where the pipe 5 conveying the cleansing medium opens, said valve allowing the cleansing medium to be conveyed to the bristles 71 but preventing, for example, water from getting into the pipe 5. When more solid and paste-like cleansing mediums are used the valve is not necessary. An aerator valve 29 is also arranged in the frame portion 21 and it is in connection with the surrounding space and the container portion 11 in order to balance the pressure in the container portion. The casing of the container portion 11 contains a valve opening 111 intended to settle at the aerator valve 29 when the container portion is attached to the frame portion 21.

The pressure membrane 22 consists of a flexible material whereby the return movement of the pressure membrane 22 after being pressed is secured by means of a spring member 24. The pressure membrane can also be made of a flexibly reversible material in which case the spring member is not needed.

In FIG. 2 a preferred structure of the pump device is shown in closer detail. The pump device 2, or the pressure membrane pump, comprises a frame portion 21. A cylindrical recess 25 is formed in the frame portion and a cylindrical adapting body 26 is fitted into said recess. An intermediate space 32 is formed essentially in the middle of the adapting body 26, whereby valve housings 34 and 36 comprised in the valves 31 and 33 are formed in the lower portion of the adapting body 26 on both sides of the intermediate space 32, and advantageously spherical unattached valve members 35 and 37 are arranged in said valve housings. The valve housings 34 and 36 are formed on the lower portion of the adapting body 26 on its outer circumference and they are open for mounting of the valve members 35 and 37 before being fitted into the recess 25. The valve housings 34 and 36 are closed when the adapting body 26 is fitted into the recess 25. The valve 31 forms an inlet valve connection, i.e. a connection to the pipe 4 leading to the container portion 11. The valve 33 forms an outlet valve connection, i.e. a connection via the arm portion 6 to the pipe 5 leading to the brush portion 7. The line leading from the container portion 11 to the bristles 71, which consists of the pump 2 and pipes 4 and 5, is almost straight in order to avoid clogging.

The pressure membrane 22 is dome-shaped, whereby it is arranged as a dome placed around the upper portion of the adapting body 26. In order to secure the fastening the pressure membrane 22 contains a projection 221 settling into the recess 261 in the adapting body. The pressure membrane can be attached to the adapting body in several ways, for example with a ring flange.

In the upper portion of the adapting body 26, as an extension to the intermediate space 32 is a stair-like expansion 321 in the region of the pressure membrane 22 to support the spring member 24 connected to the pressure membrane.

The frame portion 21 has an essentially cylindrical cross section. The frame portion 21 is provided with sliding surfaces 27 on the other side of the frame portion 21 in order to seal the attachment of the container portion 11 which is attached with an interference fitting. A corresponding arrangement including sliding surfaces 28 is provided also on the other side of the frame portion 21 to which the arm portion 6 is attached by means of an interference fitting. It is obvious that the mutual attachments of these portions can be carried out in some other way, for example, by means of a pipe thread 27', 28' shown in FIG. 3.

When there is cleansing medium in the container portion 11 the pump toothbrush is used, for example, in the following way.

The membrane 22 of the pump device 2 is pressed downwards whereby a pressure effect is achieved in the intermediate space 32. Hereby the spherical valve member 35 is pressed against the interconnector 311 leading to the pipe 4 and closes the valve 31. When the pressure membrane 22 is released it is reversed to its original position, whereby a suction effect is provided in the intermediate space 32 opening the interconnector 311 whereby cleansing medium is sucked from the container portion 11 into the intermediate space 32 via the pipe 4 and the open interconnectors 311 and 312.

The pressure membrane 22 is pressed again whereby the valve member 35 is once more pressed against the interconnector 311 closing the valve 31 and opening the valve 33 when the valve member 37 extends out from the interconnector 331 leading out from the intermediate space 32. The interconnector 332 leading to the pipe 5 remains open at this stage and the cleansing medium can flow through the pipe 5 to the brush portion 7 and the bristles 71.

Thus it is possible to regulate by a simple pressing movement the feeding of the cleansing medium to the bristles 71 of the brush portion 7.

The cross section of the casing portion of the pump toothbrush, i.e. in practice the grip portion/container portion, the pump device/frame portion and the arm portion, can be of some other shape than cylindrical. The recess in the frame portion and the adapting body fitted into it do not have to be cylindrical, instead they can, for example, be polygonal or the like.

The container portion is advantageously made of a transparent material in order to facilitate monitoring of the amount of cleansing medium.

Additionally the container portion can be provided with filling means facilitating the refilling of it.

The pressure membrane may, for example, be round or elliptic, preferably it should, however, adjust to the form of the casing of the pump toothbrush. The location of the pressure membrane can be chosen according to respective use. There can also be more than one pressure membrane, for example two pressure membranes arranged on opposite sides of the pump toothbrush.

The spherical valve members may be replaced with, for example, spring-acting balls or spheres, clap valve members or other solutions operating in a similar way.

The pump toothbrush may be provided with a cover in order to protect the brush portion, preferably one which is congruent with the shape of the casing of the pump toothbrush.

The drawing and the description relating to it are only intended to illustrate the inventive idea. The pump toothbrush according to the invention may vary within the scope of the enclosed claims.

I claim:

1. A pump toothbrush comprising: a brush portion, a grip portion and an intermediate arm portion, the grip portion comprising a container portion for a dental cleansing medium, said container portion being connected with the brush portion by a pump device in order to feed the dental cleansing medium into the brush portion through the arm portion, wherein:

the pump device comprises a frame portion arranged between the container portion and the arm portion in such a way that casings of the container portion, the frame portion and the arm portion form an essentially congruent casing surface, the frame portion comprises a generally cylindrical recess located perpendicularly with respect to the longitudinal axis of the pump toothbrush, a generally cylindrical adjusting body forming an inner portion of the pump device is fitted into the recess, said body comprising an axial outwards open intermediate space acting as a chamber of the pump device, a pressure membrane comprising a cylindrical wall part and a flexible end part closing one end of said cylindrical wall part, said cylindrical wall part being fitted into said recess and forming a seal between the adjusting body and the frame portion, said flexible end part closing said chamber of the pump device and being exposed to permit application of pressure to the flexible end part to effect actuation of the pump device inlet and outlet valves arranged in a bottom of the adjusting body opposite the pressure membrane and at opposite sides of the recess to enable connection between and transfer of dental cleansing medium from the container portion to the brush portion through the inlet and outlet valves by exerting pressure on the flexible end part of the pressure membrane.

2. A pump toothbrush according to claim 1, wherein the pump device comprises a pressure membrane pump and the intermediate space of the adjusting body is fitted into the frame portion of the pump device, the inlet valve being connected to the container portion by an interconnector, the outlet valve being connected to the brush portion by way of an interconnector, and including pipes connecting the pump device to the container portion and the brush portion, the pipes forming an essentially straight pipeline for the dental cleansing medium from the container portion to the brush portion.

3. A pump toothbrush according to claim 1, wherein the frame portion comprises an aerator valve which is in connection with a surrounding space and the container portion.

4. A pump toothbrush according to claim 2, wherein valve housings are formed on a lower portion of the adjusting body and open towards the circumference of the adjusting body, the valve housings receiving unattached valve members forming the inlet and outlet valves before the adjusting body is fitted into the recess in such a way that the valve housings are closed by an outer casing of the recess, said valve housings being located at the interconnectors in the frame portion.

5. A pump toothbrush according to claim 1, wherein a spring is connected to the flexible pressure membrane, said spring being arranged to function and increase the efficiency of the pressure in the intermediate space in a stair-like expansion under the pressure membrane.

6. A pump toothbrush according to claim 1, wherein the arm portion and the container portion are arranged to be attached to the frame portion by an interference fitting provided with sliding surfaces.

7. A pump toothbrush according to claim 1, wherein the arm portion and the container portion are attached to the frame portion by a thread.

8. A pump toothbrush according to claim 1, wherein casings forming an end of the arm portion located towards the frame portion, the frame portion and the container portion are essentially cylindrical, and the flexible pressure membrane of the pump device is round or elliptic so that it adjusts to the casings of the arm portion, the frame portion and the container portion.

9. A pump toothbrush according to claim 1, wherein the container portion has a refillable structure.

10. A pump toothbrush possessing a longitudinal axis and comprising:

a brush portion, a grip portion comprising a container portion for a dental cleansing medium, and a pump device between the container portion and the brush portion to feed dental cleansing medium from the container portion into the brush portion;

the pump device including a frame portion arranged intermediate the container portion and the brush portion, the frame portion being provided with a recess extending perpendicularly with respect to the longitudinal axis of the toothbrush;

an adjusting body fitted into the recess in the frame portion and possessing an axial outwards open intermediate space forming a chamber of the pump device;

a flexible pressure membrane closing said chamber of the pump device and being exposed to permit application of pressure to the flexible pressure membrane to effect actuation of the pump device;

an inlet valve arranged in a portion of the adjusting body that is fitted into the recess and an outlet valve arranged in a portion of the adjusting body that is fitted into the recess, the inlet and outlet valves enabling connection between and transfer of dental cleansing medium from the container portion to the brush portion through the inlet and outlet valves as a result of pressure exerted on the flexible pressure membrane.

11. A pump toothbrush according to claim 10, wherein the inlet valve is connected to the container portion by an interconnector and the outlet valve is connected to the brush portion by way of an interconnector, and including pipes connecting the pump device to the container portion and the brush portion, the pipes forming an essentially straight pipeline for the dental cleansing medium from the container portion to the brush portion.

12. A pump toothbrush according to claim 10, wherein the frame portion comprises an aerator valve which is in connection with a surrounding space and the container portion.

13. A pump toothbrush according to claim 10, including valve housings formed on a lower portion of the adjusting body and opening towards an outer surface of the adjusting body, the valve housings receiving unattached valve members forming the inlet and outlet valves, said valve housings being located at the interconnectors in the frame portion.

14. A pump toothbrush according to claim 10, including a spring mounted in the adjusting body and bearing against the flexible pressure membrane.

15. A pump toothbrush according to claim 10, wherein the pump device is a pressure membrane pump.

16. A pump toothbrush according claim 10, wherein the arm portion and the container portion are attached to the frame portion by an interference fitting provided with sliding surfaces.

17. A pump toothbrush according to claim 10, wherein the arm portion and the container portion are attached to the frame portion by a thread.

18. A pump toothbrush according to claim 10, wherein casings forming an end of the arm portion located towards the frame portion, the frame portion and the container portion are essentially cylindrical, and the flexible pressure membrane of the pump device is round or elliptic.

19. A pump toothbrush according to claim 10, wherein the adjusting body is stationarily positioned within the recess in the frame portion when pressure is exerted on the flexible pressure membrane to transfer dental cleansing medium from the container portion to the brush portion through the inlet and outlet valves.

20. A pump toothbrush according to claim 10, wherein the inlet and outlet valves are positioned on opposite sides of the adjusting body.

* * * * *

UNITED STATES PATENT AND TRADEMARK OFFICE
Certificate

Patent No. 5,918,995 Patented: July 6, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Juha-Pekka Puurunen, Kaavi, Finland; and Kari Tapani Helenius, Perniö, Finland.

Signed and Sealed this Third Day of April 2007.

GREGORY L. HUSON
*Supervisory Patent Examiner*
Art Unit 3751